US008554612B1

(12) United States Patent
Hernandez

(10) Patent No.: US 8,554,612 B1
(45) Date of Patent: Oct. 8, 2013

(54) WEB BASED DOMINO TOURNAMENT SYSTEM WITH PRIZE INCENTIVES

(76) Inventor: Alberto Hernandez, Miami, FL (US)

( * ) Notice: Subject to any disclaimer, the term of this patent is extended or adjusted under 35 U.S.C. 154(b) by 0 days.

(21) Appl. No.: 13/328,940

(22) Filed: Dec. 16, 2011

(51) Int. Cl.
*G06Q 30/00* (2012.01)
*A63F 9/24* (2006.01)

(52) U.S. Cl.
USPC ..... 705/14.12; 463/42; 705/14.14

(58) Field of Classification Search
USPC .... 463/11, 16, 20, 25–26, 41–42; 705/14.12, 705/26.61, 26.7, 71
See application file for complete search history.

(56) References Cited

U.S. PATENT DOCUMENTS

| | | | | |
|---|---|---|---|---|
| 5,791,991 | A * | 8/1998 | Small | 463/41 |
| 6,061,660 | A * | 5/2000 | Eggleston et al. | 705/14.12 |
| 2001/0034659 | A1* | 10/2001 | Kobayashi | 705/26 |
| 2007/0167210 | A1* | 7/2007 | Kelly et al. | 463/16 |
| 2007/0218979 | A1* | 9/2007 | Momoda et al. | 463/25 |
| 2008/0140577 | A1* | 6/2008 | Rahman et al. | 705/71 |
| 2008/0176613 | A1* | 7/2008 | Yoshizawa | 463/11 |
| 2009/0005152 | A9* | 1/2009 | Kelly et al. | 463/20 |
| 2009/0124361 | A1* | 5/2009 | Gilmore | 463/26 |
| 2011/0082763 | A1* | 4/2011 | Leite et al. | 705/26.7 |
| 2011/0092268 | A1* | 4/2011 | Vann et al. | 463/20 |
| 2012/0309541 | A1* | 12/2012 | Kofman et al. | 463/42 |

OTHER PUBLICATIONS

John Mclead, Partnership Dominoes, Dec. 2, 2008, http://www.pagat.com/tile/wdom/partnership.html.*
Rubl.com, Dominoes Internet Tournaments, Feb. 9, 2007, http://www.rubl.com/rules/dominoes-tournaments.html.*

* cited by examiner

*Primary Examiner* — Dmitry Suhol
*Assistant Examiner* — Jason Yen
(74) *Attorney, Agent, or Firm* — Albert Bordas, P.A.

(57) ABSTRACT

An online domino tournament system with prize incentives, including the steps of surfing the Internet with a computer to identify a website of a desired vendor; identifying a desired product to play for in the website; obtaining relevant information pertaining to the desired vendor and the desired product; logging into a server of an administrator; providing the relevant information to the server; categorizing a player according to the desired product by the administrator; accepting playing category and paying ticket price by the player to proceed, otherwise starting over; playing an online domino tournament and proceeding to end if the player loses, otherwise the player becomes a winner; ordering the desired product from the desired vendor by the administrator on behalf of the winner; sending the desired product to the winner; and paying the vendor.

12 Claims, 4 Drawing Sheets

WEB BASED DOMINO TOURNAMENT SYSTEM WITH PRIZE INCENTIVES

BACKGROUND OF THE INVENTION

1. Field of the Invention

The present invention relates to domino tournaments, and more particularly, to online domino tournament systems with prize incentives.

2. Description of the Related Art

Many online games have been developed in the past. However, Applicant is not aware of any online domino tournament systems with prize incentives having the novel features of the present invention.

SUMMARY OF THE INVENTION

The instant invention is an online domino tournament system with prize incentives, including the steps of surfing the Internet with a computer to identify a website of a desired vendor; identifying a desired product to play for in the website; obtaining relevant information pertaining to the desired vendor and the desired product; logging into a server of an administrator; providing the relevant information to the server; categorizing a player according to the desired product by the administrator; accepting playing category and paying ticket price by the player to proceed, otherwise starting over; playing an online domino tournament and proceeding to end if the player loses, otherwise the player becomes a winner; ordering the desired product from the desired vendor by the administrator on behalf of the winner; sending the desired product to the winner; and paying the vendor.

It is therefore one of the main objects of the present invention to provide an online domino tournament system with prize incentives, including the steps of surfing the Internet with a computer to identify a website of a desired vendor.

It is another object of this invention to provide an online domino tournament system with prize incentives, including the steps of identifying a desired product to play for in the website.

It is another object of this invention to provide an online domino tournament system with prize incentives, including the steps of obtaining relevant information pertaining to the desired vendor and the desired product; and logging into a server of an administrator.

It is another object of this invention to provide an online domino tournament system with prize incentives, including the steps of providing the relevant information to the server.

It is another object of this invention to provide an online domino tournament system with prize incentives, including the steps of categorizing a player according to the desired product by the administrator.

It is another object of this invention to provide an online domino tournament system with prize incentives, including the steps of accepting playing category and paying ticket price by the player to proceed, otherwise starting over.

It is another object of this invention to provide an online domino tournament system with prize incentives, including the steps of playing an online domino tournament and proceeding to end if the player loses, otherwise the player becomes a winner.

It is another object of this invention to provide an online domino tournament system with prize incentives, including the steps of ordering the desired product from the desired vendor by the administrator on behalf of the winner; sending the desired product to the winner; and paying the vendor.

It is yet another object of this invention to implement such a method that is inexpensive to initiate and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
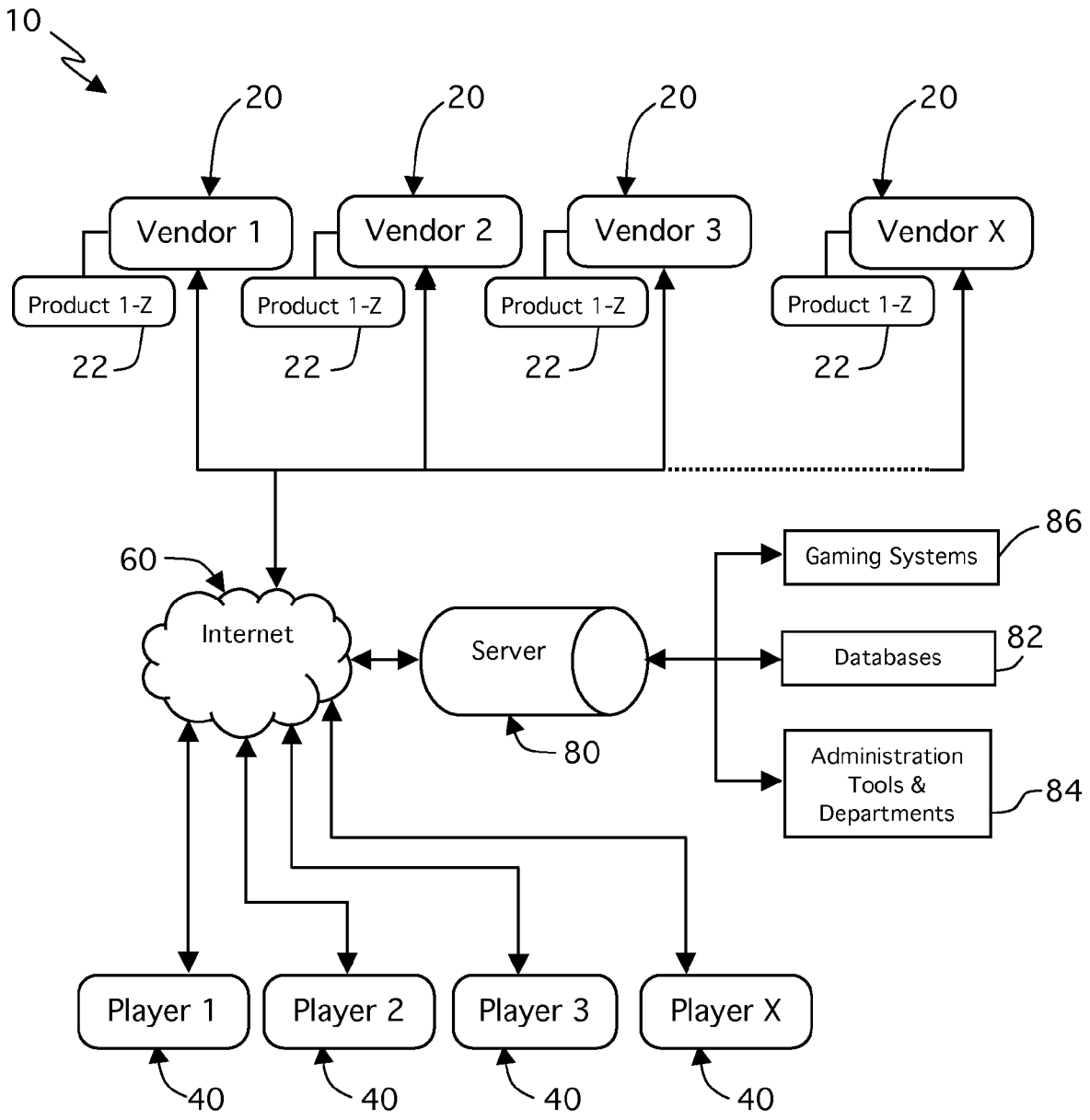
FIG. 1 is a schematic representation of the online domino tournament system with prize incentives, object of the present invention.

Referring now to the drawings, the present invention is an online domino tournament system with prize incentives, and is generally referred to with numeral 10. It can be observed that it basically includes vendors 20, players 40, Internet 60, and server 80.

As seen in FIG. 1, vendors 20 include Vendor 1; Vendor 2; Vendor 3; through Vendor X. Vendor X can be any number greater than zero. Each of vendors 20 has their own respective product(s) 22. The respective product(s) 22 can be a single product "1", or multiple products ending at "Z". "Z" can be any number greater than one. Via Internet 60, each of vendors 20 connects to server 80 through a website administered by administration tools and departments 84, to offer their respective product(s) 22 for approval and/or acceptance by administration tools and departments 84. Administration tools and departments 84 is effectively an administrator. Each vendor 20 can offer 1 to Z product(s) 22. Accepted 1 to Z product(s) 22 are identified and filed within databases 82 by administration tools and departments 84 and classified for the online domino tournaments organized by gaming systems 86. Players 40 include Player 1; Player 2; Player 3; through Player X. Player X can be any number greater than zero. In a preferred embodiment, Player X is at least 4, and multiples of 4 to play the online domino tournaments. Players 40 wanting to play the online domino tournaments register online with administration tools and departments 84 and are filed within databases 82.

Figure 2:
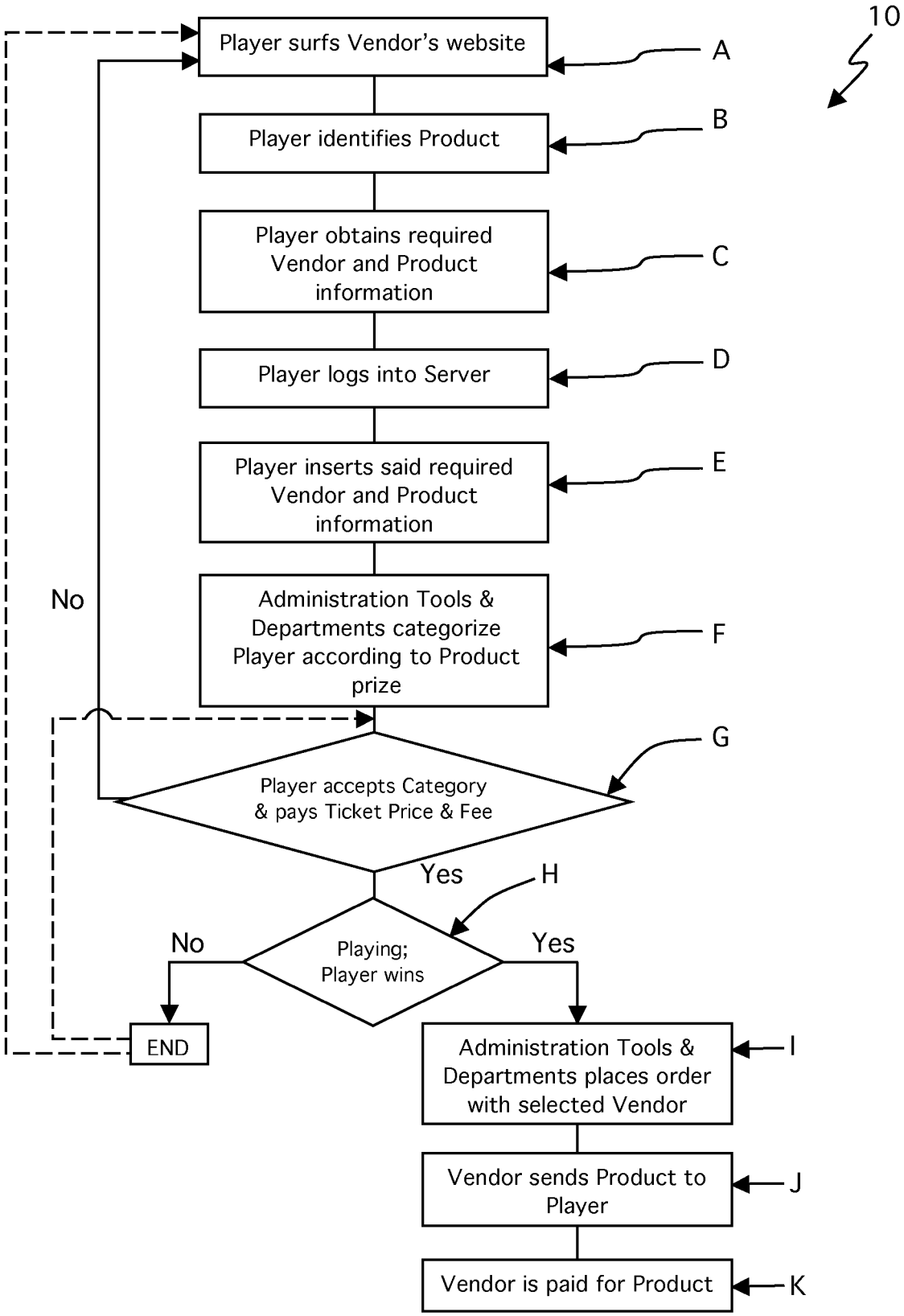
FIG. 2 is a flowchart of the online domino tournament system with prize incentives, object of the present invention.

As seen in FIG. 2, instant invention 10, defined as an online domino tournament system with prize incentives, comprises the steps of:

A) surfing the Internet with a computer to identify a website of a desired vendor.

Regarding Step A), each player 40 on a respective computer or computer device such as a tablet, smartphone, or the like, goes online through Internet 60.

B) identifying a desired product to play for in said website.

Regarding Step B), each player 40 then identifies the desired product(s) 22 utilizing the computer or computer device such as the tablet, smartphone, or the like.

C) obtaining relevant information pertaining to said desired vendor and said desired product.

Regarding Step C), each player 40 then obtains the relevant information for each of the desired product(s) 22 utilizing the computer or computer device such as the tablet, smartphone, or the like.

D) logging into a server of an administrator.

Regarding Step D), each player 40 then logs into server 80 of administration tools and departments 84 utilizing the computer or computer device such as the tablet, smartphone, or the like.

E) providing said relevant information to said server.

Regarding Step E), each player 40 then provides the relevant information to server 80 utilizing the computer or computer device such as the tablet, smartphone, or the like.

F) categorizing a player according to said desired product by said administrator.

Regarding Step F), administration tools and departments 84 categorize each player 40 according to their respective desired products within databases 82.

G) accepting playing category and paying ticket price by said player to proceed to Step H), otherwise proceeding to Step A).

Regarding Step G), each player 40 accepts the playing category and paying ticket price established by administration tools and departments 84. If player 40 does not accept the playing category and paying ticket price established by administration tools and departments 84, each player 40 has the option to start again by proceeding to Step A.

H) playing an online domino tournament and proceeding to end if said player loses, otherwise said player becomes a winner and proceeds to Step I);

Regarding Step H), each player 40 plays the online domino tournament administered by gaming systems 86. If a player 40 loses the online domino tournament, player 40 is eliminated and is not eligible for any prize. The losing player 40 may then start over at Step A) or at the beginning of Step G. If a player 40 wins the online domino tournament, which may require multiple rounds of domino playing, player 40 becomes a winner and proceeds to Step I).

I) ordering said desired product from said desired vendor by said administrator on behalf of said winner.

Regarding Step I), gaming systems 86 sends a communication to administration tools and departments 84 of the particular winning player 40. Administration tools and departments 84 orders the desired product(s) 22 from said desired vendor 20 by administration tools and departments 84 on behalf of said winning player 40.

J) sending said desired product to said winner; and

Regarding Step J), desired vendor 20 sends the desired product(s) 22 to the winning player 40.

K) paying said vendor.

Regarding Step K), administration tools and departments 84 sends payment to desired vendor 20 for the desired product (s) 22 that was sent to the winning player 40.

Figure 3:
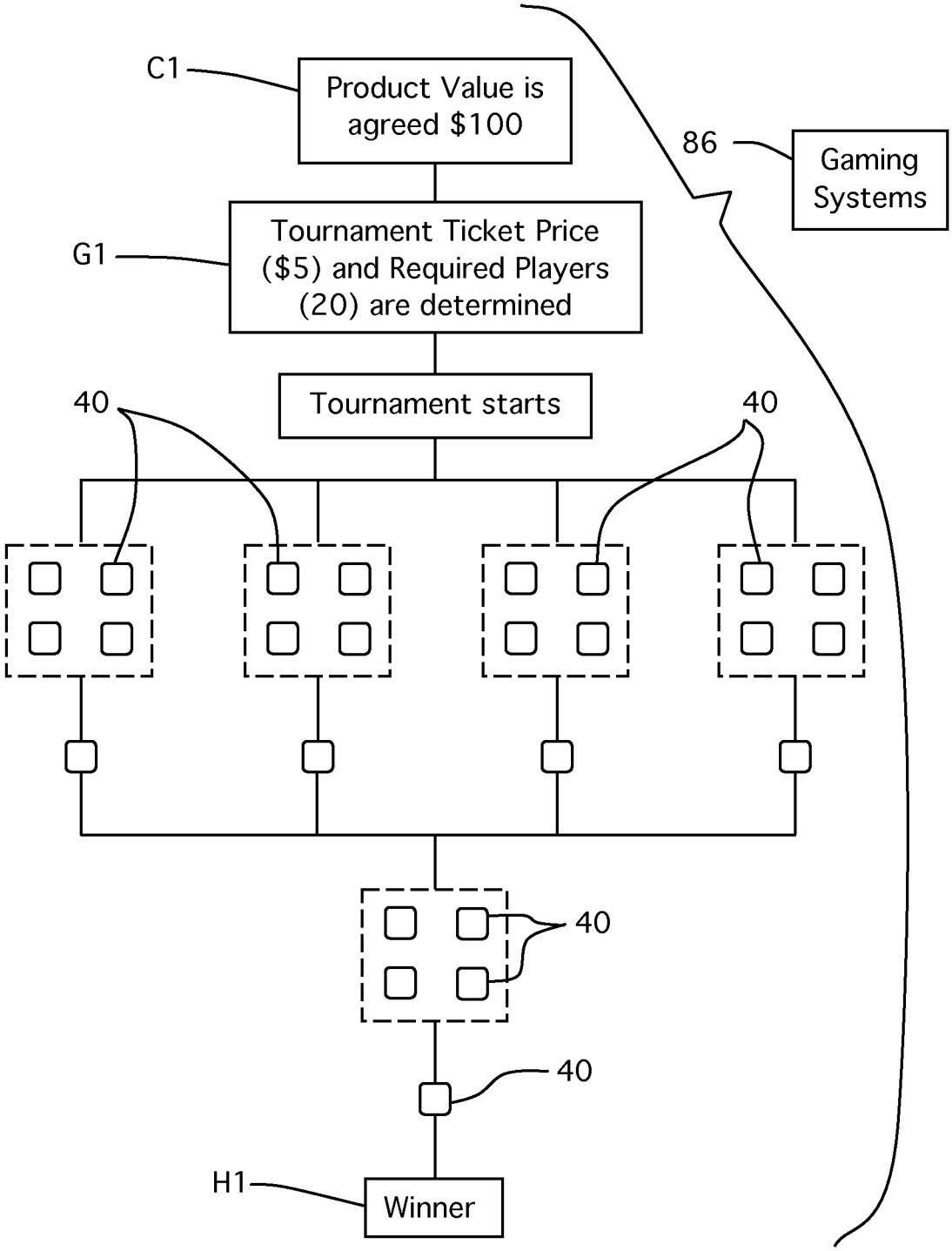
FIG. 3 is a partial flowchart illustration of the domino tournament system.

As seen in FIG. 3, gaming systems 86 provides, administers, and manages the online domino tournament.

In Step C) of the instant method: obtaining relevant information pertaining to said desired vendor and said desired product; each player 40 then obtains the relevant information for each of the desired product(s) 22 utilizing the computer or computer device such as the tablet, smartphone, or the like. This step also defines the desired product(s) 22 that are agreed to by administration tools and departments 84 and vendors 20 at C1.

In Step G) of the instant method: accepting playing category and paying ticket price by said player to proceed to Step H), otherwise proceeding to Step A); each player 40 accepts the playing category and paying ticket price established by administration tools and departments 84. If player 40 does not accept the playing category and paying ticket price established by administration tools and departments 84 each player 40 has the option to start again by proceeding to Step A. In this step, administration tools and departments 84 determines the ticket prices and coordinates the players to play against each other with gaming systems 86 at G1.

In Step H) of the instant method: playing an online domino tournament and proceeding to end if said player loses, otherwise said player 40 becomes a winner and proceeds to Step I); each player 40 plays the online domino tournament administered by gaming systems 86. If a player 40 loses the online domino tournament, player 40 is eliminated and is not eligible for any prize. The losing player 40 may then start over at Step A) or at the beginning of Step G. If a player 40 wins the online domino tournament, which may require multiple rounds of domino playing, player 40 becomes a winner and proceeds to Step I). In this step, gaming systems 86 has computerized systems with software and databases for classifying, organizing, running, administrating, and conducting the online domino tournaments. In the preferred embodiment, the online domino tournaments are based on four-person rounds, meaning that four players 40 play each other in each round. There may be multiple rounds played until a final table of 4 players 40 is reached. The winning player 40 of the final table is declared the winner at H1.

Figure 4:
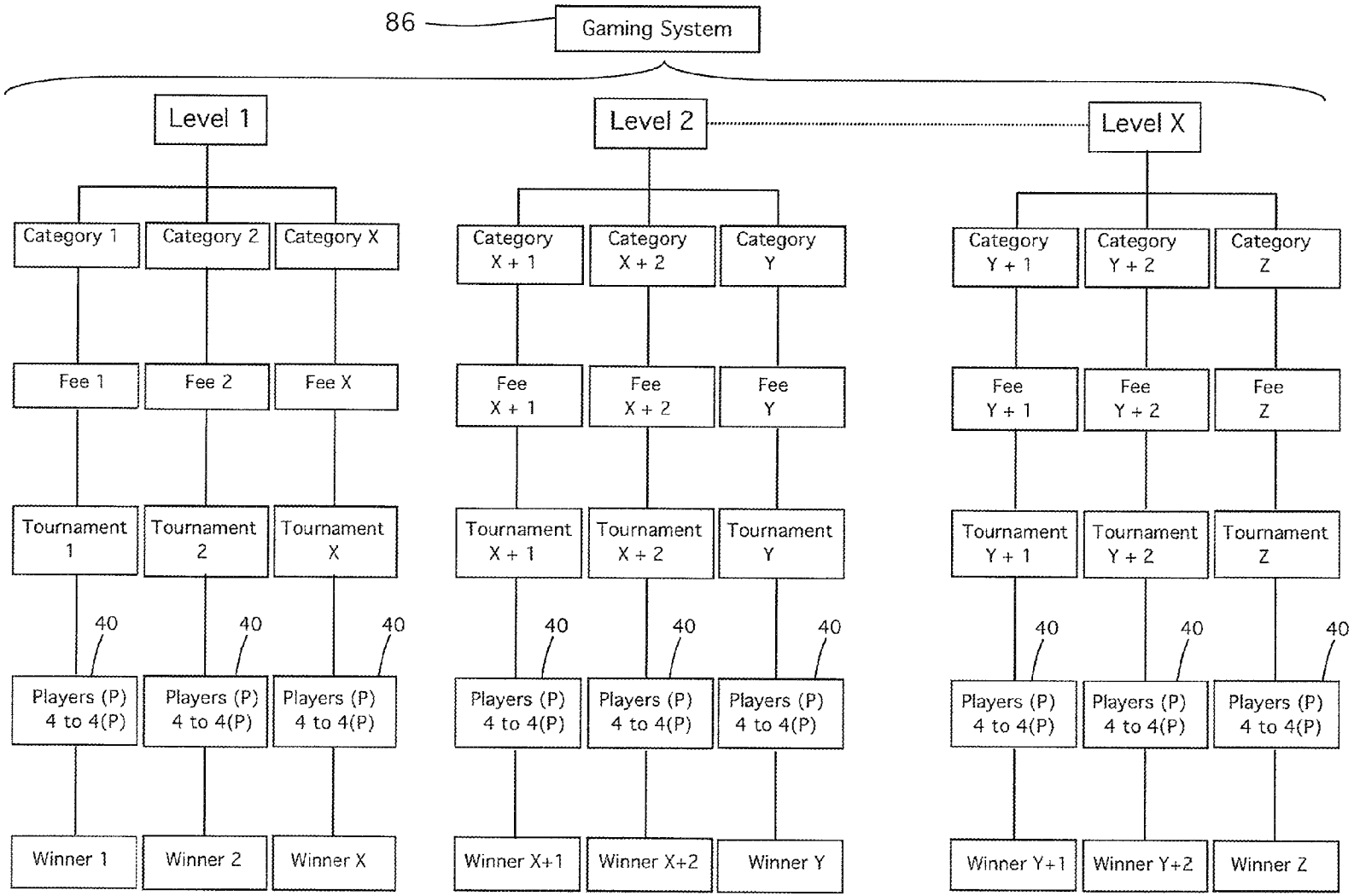
FIG. 4 is an illustration of different domino tournament playing levels for various prizes.

As seen in FIG. 4, each player 40 selects a desired level and category to play in. The desired level and category is determined by the monetary value of the desired product(s) 22; the greater the monetary value, the higher the level and category. As an example:

Level 1, Category 1 comprises the most inexpensive desired product(s) 22, and has the most inexpensive ticket price, which is the fee/price to play in an online domino tournament. Level 1, Category 2 comprises desired product (s) 22 more expensive and a ticket price greater than that of Level 1, Category 1. Level 1, Category X comprises desired product(s) 22 more expensive and a ticket price greater than that of Level 1, Category 2. It is noted that X can be any number greater than 2.

Level 2, Category X+1 comprises desired product(s) 22 more expensive and a ticket price greater than that of Level 1, Category X. Level 2, Category X+2 comprises desired product(s) 22 more expensive and a ticket price greater than that of Level 2, Category X+1. Level 2, Category Y comprises desired product(s) 22 more expensive and a ticket price greater than that of Level 2, Category X+2. It is noted that Y can be any number greater than X+2.

There are a predetermined number of Levels until Level X.

Level X, Category Y+1 comprises desired product(s) 22 more expensive and a ticket price greater than that of Level 2, Category Y. Level X, Category Y+2 comprises desired product(s) 22 more expensive and a ticket price greater than that of Level X, Category Y+1. Level X, Category Z comprises desired product(s) 22 more expensive and a ticket price greater than that of Level X, Category Y+2. It is noted that Z can be any number greater than Y+2.

Therefore instant invention 10, defined as an online domino tournament system with prize incentives, comprises the steps of:

A) surfing the Internet with a computer to identify a website of a desired vendor;

B) identifying a desired product to play for in said website;

C) obtaining relevant information pertaining to said desired vendor and said desired product;

D) logging into a server of an administrator;

E) providing said relevant information to said server;

F) categorizing a player according to said desired product by said administrator;

G) accepting playing category and paying ticket price by said player to proceed to Step H), otherwise proceeding to Step A);

H) playing an online domino tournament and proceeding to end if said player loses, otherwise said player becomes a winner and proceeds to Step I);

I) ordering said desired product from said desired vendor by said administrator on behalf of said winner;

J) sending said desired product to said winner; and

K) paying said vendor.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An online domino tournament system with prize incentives, comprising the steps of:

A) surfing the Internet by a player with a respective computer or computer device to identify a website of a desired vendor;

B) identifying a desired product to play for in said website, whereby said player identifies said desired product utilizing said respective computer or computer device;

C) obtaining relevant information pertaining to said desired vendor and said desired product, whereby said player obtains said relevant information for each of said desired product utilizing said respective computer or computer device;

D) logging into a server of an administrator, whereby said player logs into said server of said administrator utilizing said respective computer or computer device;

E) providing said relevant information to said server, whereby each said player selects a desired level and category to play in, said desired level and category is determined by a monetary value of said desired product, whereby a greater said monetary value, a higher said level and category, said player provides said relevant information to said server utilizing said respective computer or computer device;

F) categorizing a player according to said desired product by said administrator, whereby said administrator categorizes each said player according to their respective said desired product within databases;

G) accepting playing category and paying ticket price by said player to proceed to Step H), otherwise proceeding to Step A), whereby said player accepts said playing category and said paying ticket price established by said administrator utilizing said respective computer or computer device, if said player does not accept said playing category and said paying ticket price established by said administrator, said player has an option to start again by proceeding to Step A utilizing said respective computer or computer device;

H) playing an online domino tournament and proceeding to end if said player loses, otherwise said player becomes a winner and proceeds to Step I) utilizing said respective computer or computer device;

I) ordering said desired product from said desired vendor by said administrator on behalf of said winner;

J) sending said desired product to said winner; and

K) paying said vendor.

2. The online domino tournament system with prize incentives set forth in claim 1, further characterized in that said player plays said online domino tournament administered by gaming systems of said administrator, if said player loses said online domino tournament, said player is eliminated and is not eligible for any prize being said desired product, said player defined as a losing player may then start over at Step A) or at beginning of Step G, if said player wins said online domino tournament, which may require multiple rounds of domino playing, said player becomes a winner and proceeds to Step I).

3. The online domino tournament system with prize incentives set forth in claim 1, further characterized in that gaming systems sends a communication to said administrator of a particular winning said player and orders said desired product from said desired vendor on behalf of winning said player.

4. The online domino tournament system with prize incentives set forth in claim 1, further characterized in that said desired vendor sends said desired product to a winning player.

5. The online domino tournament system with prize incentives set forth in claim 1, further characterized in that said administrator sends payment to said desired vendor for said desired product sent to a winning player.

6. The online domino tournament system with prize incentives set forth in claim 1, further characterized in that gaming systems provides, administers, and manages said online domino tournament.

7. The online domino tournament system with prize incentives set forth in claim 1, further characterized in that each said desired product are agreed to by said administrator and each respective said desired vendor.

8. The online domino tournament system with prize incentives set forth in claim 1, further characterized in that said administrator determines said ticket price and coordinates each said player to play against each other with gaming systems.

9. The online domino tournament system with prize incentives set forth in claim 1, further characterized in that gaming systems of said administrator has computerized systems with software and databases for classifying, organizing, running, administrating, and conducting said online domino tournaments.

10. The online domino tournament system with prize incentives set forth in claim 1, further characterized in that said online domino tournaments are based on four-person rounds.

11. The online domino tournament system with prize incentives set forth in claim 1, further characterized in that said online domino tournaments are based on four of said player playing each other in each round.

12. The online domino tournament system with prize incentives set forth in claim 1, further characterized in that said online domino tournaments comprise multiple rounds played until a final table of four of said player is reached, a winning player of said final table is declared a winner.

* * * * *